US010625521B2

(12) United States Patent
Martin Vidal et al.

(10) Patent No.: US 10,625,521 B2
(45) Date of Patent: Apr. 21, 2020

(54) PRINT MEDIA SUPPORT ASSEMBLY AND PRINT PLATEN ASSEMBLY

(71) Applicants: HEWLETT-PACKARD DEVELOPMENT COMPANY, L.P., Houston, TX (US); Pau Martin Vidal, Barcelona (ES); Alberto Arredondo, Barcelona (ES); Eduardo Martin Orue, Barcelona (ES); Alberto Borrego Lebrato, San Cugat del Valles (ES); Ricardo Sanchis Estruch, Barcelona (ES)

(72) Inventors: Pau Martin Vidal, Barcelona (ES); Alberto Arredondo, Barcelona (ES); Eduardo Martin Orue, Barcelona (ES); Alberto Borrego Lebrato, San Cugat del Valles (ES); Ricardo Sanchis Estruch, Barcelona (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 594 days.

(21) Appl. No.: 15/312,486

(22) PCT Filed: Jun. 2, 2014

(86) PCT No.: PCT/EP2014/061371
§ 371 (c)(1),
(2) Date: Nov. 18, 2016

(87) PCT Pub. No.: WO2015/185092
PCT Pub. Date: Dec. 10, 2015

(65) Prior Publication Data
US 2017/0136787 A1 May 18, 2017

(51) Int. Cl.
*B41J 11/00* (2006.01)
*B41J 11/06* (2006.01)
*B41J 11/04* (2006.01)

(52) U.S. Cl.
CPC ..... *B41J 11/0085* (2013.01); *B41J 11/001* (2013.01); *B41J 11/007* (2013.01); *B41J 11/04* (2013.01); *B41J 11/06* (2013.01)

(58) Field of Classification Search
CPC ..... B41J 11/0085; B41J 11/007; B41J 11/06
See application file for complete search history.

(56) References Cited

U.S. PATENT DOCUMENTS 4,831,419 A * 5/1989 Iaia, Jr. ..... B65H 5/224 271/197
5,717,446 A 2/1998 Teumer et al.
(Continued)

FOREIGN PATENT DOCUMENTS

CN 1619428 5/2005
CN 101624146 1/2010
(Continued)

OTHER PUBLICATIONS

Hewlett Packard Development Company, L.P. HP DesignJet Z6100 Series High Productivity at High Image Quality. Mar. 2007.

*Primary Examiner* — Alessandro V Amari
*Assistant Examiner* — Kendrick X Liu
(74) *Attorney, Agent, or Firm* — HP Inc. Patent Department

(57) ABSTRACT

A print media support assembly includes a print platen structure having a number of through holes for applying a vacuum from a bottom side to a surface of the print platen structure, and a number of sinkholes in the surface of the print platen structure, each sinkhole associated with at least one through hole for distributing a vacuum, applied via the through holes, across the surface of the print platen struc-
(Continued)

ture; the print platen structure supporting a print medium in a print zone; and at least one vacuum belt running across the surface of the print platen structure in a direction of print media advance, the belt overlapping with only part of the surface of the print platen structure to form at least one belt area and at least one non-belt area on the print platen structure; wherein at least one of the density and the size of the through holes and the distribution, the area and the shape of a footprint of the sinkholes is different between the belt area and the non-belt area.

18 Claims, 8 Drawing Sheets

(56) References Cited

U.S. PATENT DOCUMENTS

| | | | | |
|---|---|---|---|---|
| 6,517,179 | B2 | 2/2003 | Hinojosa et al. | |
| 2002/0060408 | A1 | 5/2002 | Yraceburu et al. | |
| 2002/0071016 | A1* | 6/2002 | Wotton | B41J 11/002 347/102 |
| 2005/0157144 | A1 | 7/2005 | Silverbrook | |
| 2008/0053793 | A1* | 3/2008 | Yasuda | B41J 11/007 198/582 |
| 2011/0122211 | A1* | 5/2011 | Ikeda | B41J 2/155 347/104 |
| 2012/0069085 | A1* | 3/2012 | Yamagishi | B41J 2/1714 347/30 |

FOREIGN PATENT DOCUMENTS

| | | |
|---|---|---|
| CN | 201737180 | 2/2011 |
| CN | 102470678 | 5/2012 |
| CZ | 9301690 | 10/1994 |
| JP | S57-184054 | 11/1982 |
| JP | 2000191175 | 7/2000 |
| JP | 3239256 | 12/2001 |
| JP | 2009249060 | 10/2009 |
| JP | 2009280321 A * | 12/2009 |
| JP | 201251330 | 3/2012 |

* cited by examiner

PRINT MEDIA SUPPORT ASSEMBLY AND PRINT PLATEN ASSEMBLY

An important part in a large format printer is the print platen. The print platen provides a very controlled flat surface to support print media that is to be printed on. In inkjet printing systems, maintaining a defined distance between the media and the ink pen, also referred to as printhead-to-paper spacing (PPS), it is important to achieve good printing quality and avoid any media crash while printing. One approach of maintaining media in place is by applying a hold down force normal to the print platen surface via a vacuum system.

For feeding the media across the print platen and the print zone, it is possible to use feed rollers downstream and/or upstream of the print zone provided by the print platen. It is also possible to use a vacuum belt running across the print platen and transferring the vacuum to the print media via a number of vacuum holes provided in the belt.

Examples of this disclosure are described below with reference to the drawings, wherein:

FIG. 1 shows a plan view of a print media support assembly according to one example;

FIG. 2 schematically shows a plan view of part of a print platen/vacuum belt arrangement for illustrating some principles of this disclosure;

FIGS. 3A and 3B schematically show top views of a print media support assembly for illustrating how a print medium enters the print zone and how the print medium leaves the print zone, respectively;

Figure 1:
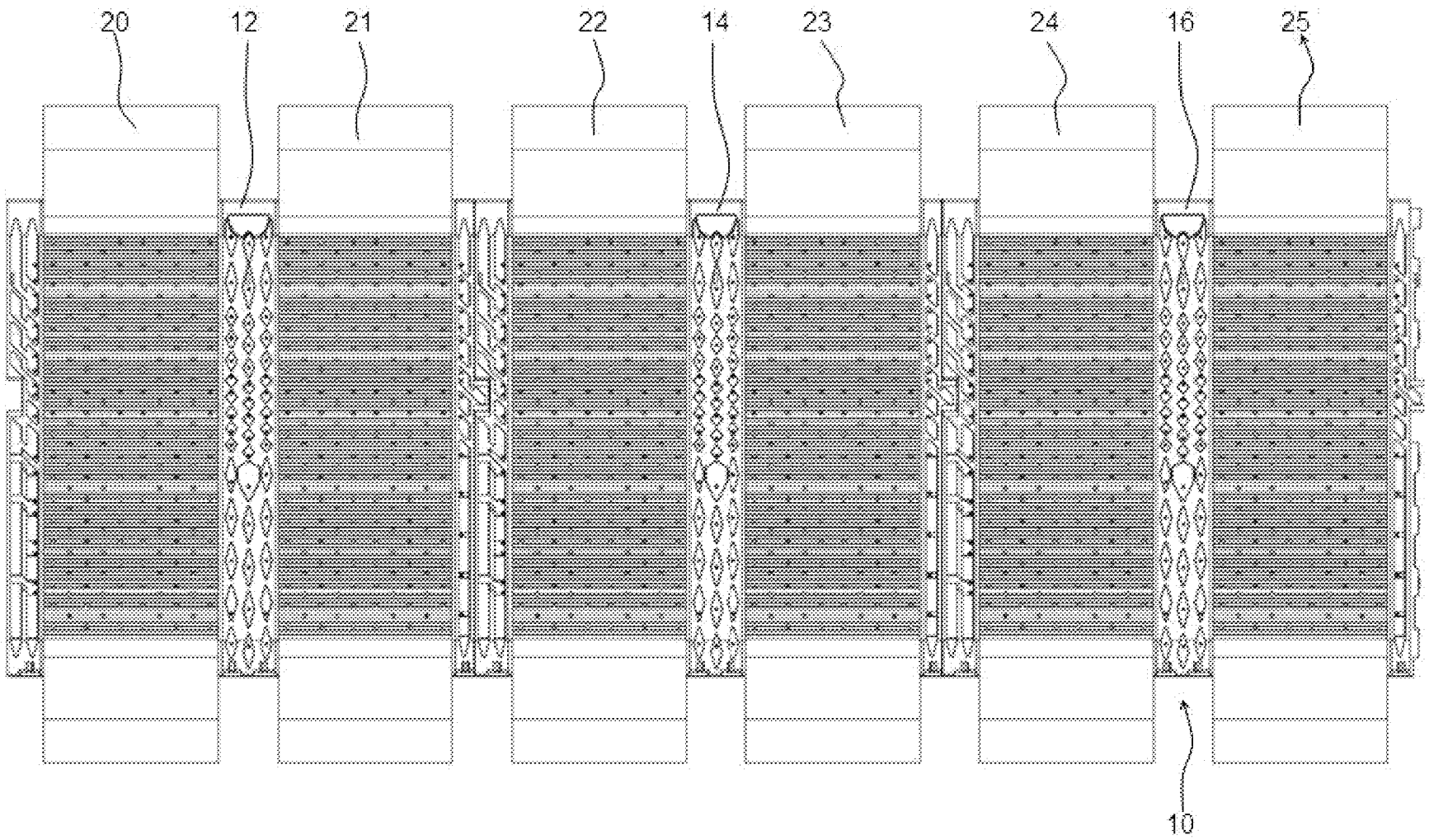

The present disclosure describes a print media support assembly including a print platen structure operating with a vacuum system and using a vacuum belt. The print platen structure comprises a single part or multiple-part print platen having a number of through holes for applying a vacuum to the surface of the print platen structure, and a number of sinkholes in the surface of the print platen structure. Each sinkhole is associated with at least one through hole for distributing a vacuum, applied via the through holes, across the surface of the print platen structure. The vacuum can be applied via a vacuum chamber provided at the bottom side of the print platen structure, wherein the vacuum is supplied to the vacuum chamber by a vacuum generator, such as a fan. One vacuum chamber for the entire print platen or several vacuum chambers for sections of the print platen may be provided.

The print platen structure supports a print medium in a print zone and the vacuum is holding down the media, providing the flatness needed for an accurate ink dot placement.

The print media support assembly of this disclosure also includes at least one vacuum belt running across the surface of the print platen structure in a direction of the print media advance in order to transport the print media through the print zone. The vacuum provided via the through holes and the sinkholes generates a sufficient force normal to the media to hold the media against the belt and to avoid any risk of slippage of the media relative to the belt when the print media is transported by the vacuum belts.

The one or more vacuum belts are overlapping with only part of the surface of the print platen structure to form at least one belt area, covered by the belt, and at least one non-belt area or exposed area of the print platen structure. In one example, media transport is achieved using a system of several belts, such as two, three, four, five, or six belts, without being limited to any particular number of belts. These belts, whose total width is less than the total print platen width, are running across the print platen surface and use the vacuum to hold and to keep flat or "iron" the print media. The vacuum effect is based on vacuum holes provided in the belts which are fed by the sinkholes and through holes provided in the print platen structure.

In the print media support assembly of this disclosure, at least one of the size and the density of the through holes and the distribution, the area and the shape of a footprint of the sinkholes in the print platen structure is different between the belt area(s) and the non-belt area(s). Adjusting the density and/or the size of the through holes and the distribution, the size and/or the shape of the sinkholes between the belt area(s) and the non-belt area(s) allows to properly feed the vacuum holes in the belt and to minimize friction between the belt and the print platen surface. Holding down the media on the belt using vacuum introduces friction to the belt drive because of the friction between the belt and the platen surface with the normal force of the vacuum. By properly adjusting the distribution and size of the through holes within the platen in combination with the distribution, size and shape of the sinkholes, the holding and "ironing" effect of the vacuum can be optimized while minimizing friction. This allows to control media flatness and to avoid loss in vacuum in the different areas across the surface of the print platen structure.

FIG. 1 shows a schematic plan view on a print media support assembly according to one example. In this example, the print media support assembly comprises a print platen structure 10 including three print platen modules 12, 14, 16 which are overlapping at edge regions, as described in further detail below. Six vacuum belts 20, 21, 22, 23, 24, 25 are running across the print platen structure 10 in a direction of print media advance, the vacuum belts 20 to 25 being shown only schematically as having vacuum holes cooperating with through holes and sinkholes provided in the print platen structure, as also described in further detail below. The vacuum belts 20 to 25 may be endless belts running across the surface of the print platen structure 10.

In one example of this disclosure, the print platen structure provides a print platen of a large format printer, and provides a print zone, a print media input zone and a print media output zone, as described in further detail below. In one non-limiting example, the print platen measures 1050 mm×350 mm wherein the print zone area only measures about 1050 mm×20 mm and hence only represents about 6% of the total area of the print platen. Constructing a print platen of this or a similar size, e.g. from a plastic part of about 1000 mm×350 mm, having a required flatness of e.g. 0.1 mm, necessitates complex production technology and is costly. The present disclosure hence proposes to separate any larger print platen structure into a number of print platen modules; in the present example, the three print platen modules 12, 14, 16 are provided which, in this example, each have a size of 333 mm×350 mm. These numbers only serve as examples and do not limit the present disclosure to any particular size of the print platen structure or number of print platen modules.

The modular design of the print platen structure, which in this example is split in three print platen modules 12, 14, 16, each having an associated vacuum chamber and vacuum generator (such as a fan), helps to reduce loss in pressure when different media sizes are used. When, for example, a print medium is used, the width of which is equal to or smaller than the width of two of the print platen modules, the vacuum generator of one of the modules can be deactivated.

At the interface of two adjacent print platen modules 12, 14 and 14, 16, measures are taken to provide good vacuum performance and to avoid loss of vacuum, as described in detail further below. In one example of this disclosure, the adjacent print platen modules overlap each other at said interfaces and a closed cell foam member is sandwiched between the overlapping side edges of adjacent print platen modules in order to obtain a good seal between the print platens. Hence vertical air flow from gaps between print platen modules at the top surface of the print platen structure can be avoided.

Figure 2:
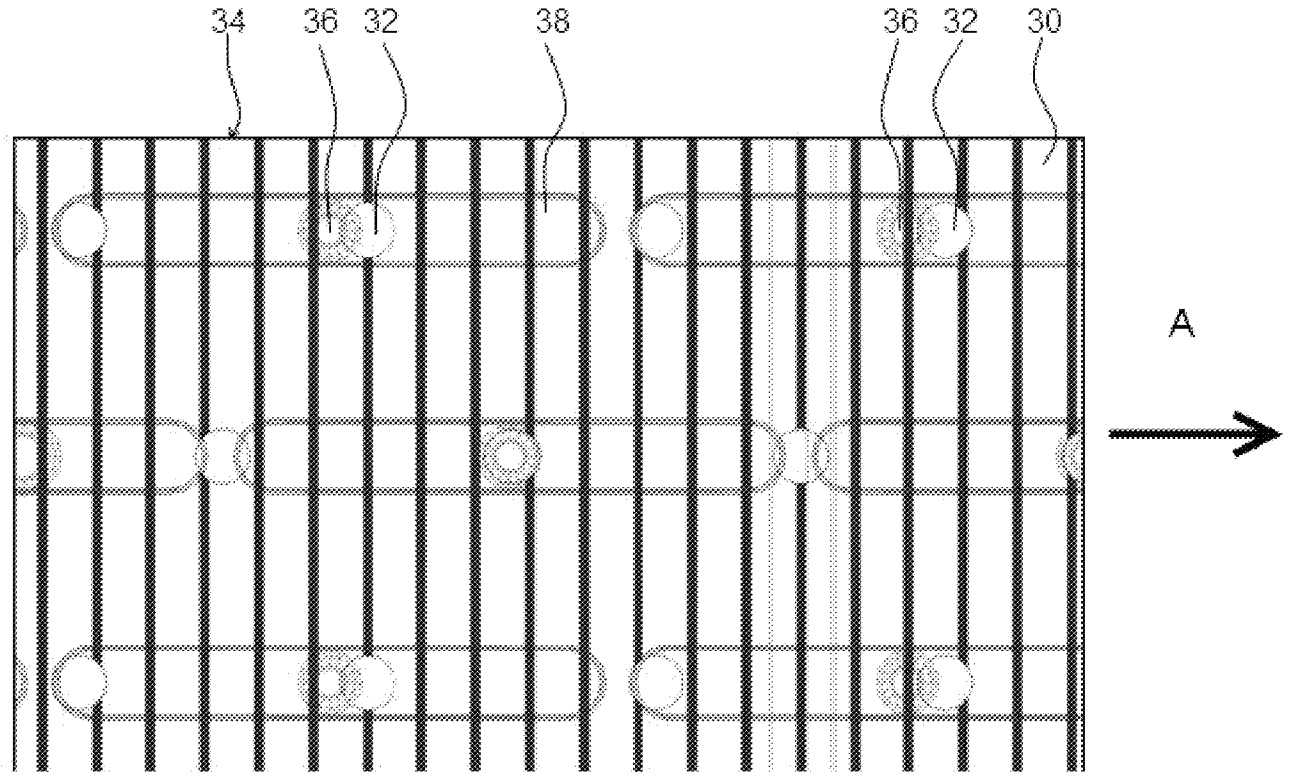

FIG. 2 schematically illustrates an example of a vacuum belt, including belt vacuum holes 32, which travels over a print platen 34 having through holes 36 for feeding a vacuum to the surface of the print platen. FIG. 2 also schematically shows sinkholes 38 provided in the surface of the print platen 34, wherein one through hole 36 is associated with each sinkhole 38. The direction of the movement of belt 30 is schematically shown by the arrow A on the right hand side of FIG. 2. A vacuum is applied to the top surface of the belt 30 via the through holes 36 and the vacuum holes 32 whenever a vacuum hole 32 of the belt 30 overlaps with one of the sinkholes 38. The sinkholes 38 hence are used for distributing the vacuum across part of the surface of the print platen 34. The vacuum holes 32 of the belt 30 are fed by the sinkholes 38 in the upper surface of the print platen. In one example of this disclosure, adjacent sinkholes 38 and through holes 36 are offset relative to one another in the media advance direction A in order to more evenly apply the vacuum to and through the belt 30.

This type of media advance system may introduce friction due to the normal force which the vacuum applies to the belt 30. The friction force F is the product of the normal force N and the friction coefficient μ: $F=N\times\mu$ The normal force N, in turn, is the product of the pressure P and the hydraulic area A: $N=P\times A$ In this case, the hydraulic area A is the area of the footprint of the sinkhole which feeds the vacuum hole 32 of the belt. It is desirable to keep the friction as low as possible. In theory, there would be three parameters for reducing the friction force:

If the friction coefficient of the print platen surface or the belt surface could be reduced, a lower friction force would be generated. However, in most print media support systems, the material of the print platen and the vacuum belt are defined in terms of material compatibility and other factors and hence should not be changed. Another way of reducing the friction would be to reduce the pressure generated by the vacuum chamber. However, the pressure value is chosen in order to securely hold, transport and keep flat all possible supported print medias so that this value cannot be changed arbitrarily. The third option for reducing the friction force is to reduce the hydraulic area which is defined by the area of the sinkholes, e.g. by their length and width. In order to provide a continuous vacuum to the vacuum belt and hence to the print media transported, the sinkholes should be arranged adjacent to each other, with little spacing, in the direction of media transport so that there is no gap in the vacuum supply. The length of the sinkholes 38 basically is defined by the total length of the print platen and the number of sinkholes allowed for assuring good vacuum performance when the vacuum holes are uncovered. On the other hand, the width of the sinkholes 38 is a variable parameter and, for reducing the area of the sinkholes, the width could be reduced down to the diameter of the through hole 32, +/− a worst case of belt displacement in the transverse direction (perpendicular to the media advance direction), so as to still ensure that all of the vacuum holes within the belt 30 are fed by the sinkholes. Given these parameters, examples of the present disclosure provide an optimum combination of the density and the size of the through holes 36, and the distribution, the area and shape of the footprint of the sinkholes 38 to ensure an optimum media hold down force and a minimum frictional force between the print platen structure and the vacuum belt. This can be achieved by varying at least one of the density and the size of the through holes and the distribution, the area and the shape of the footprint of the sinkholes differently between the belt areas and non-belt areas.

Figures 3A, 3B:
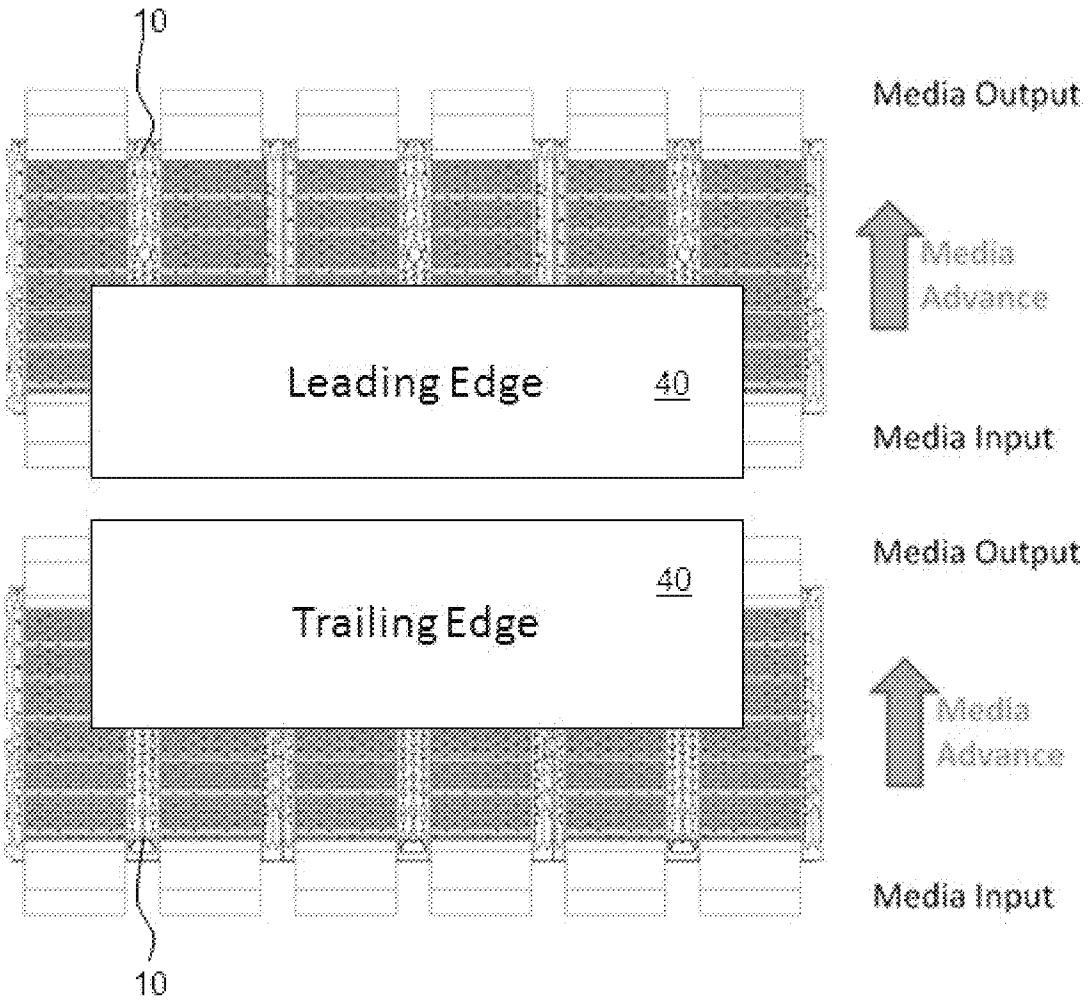
Figure 4:
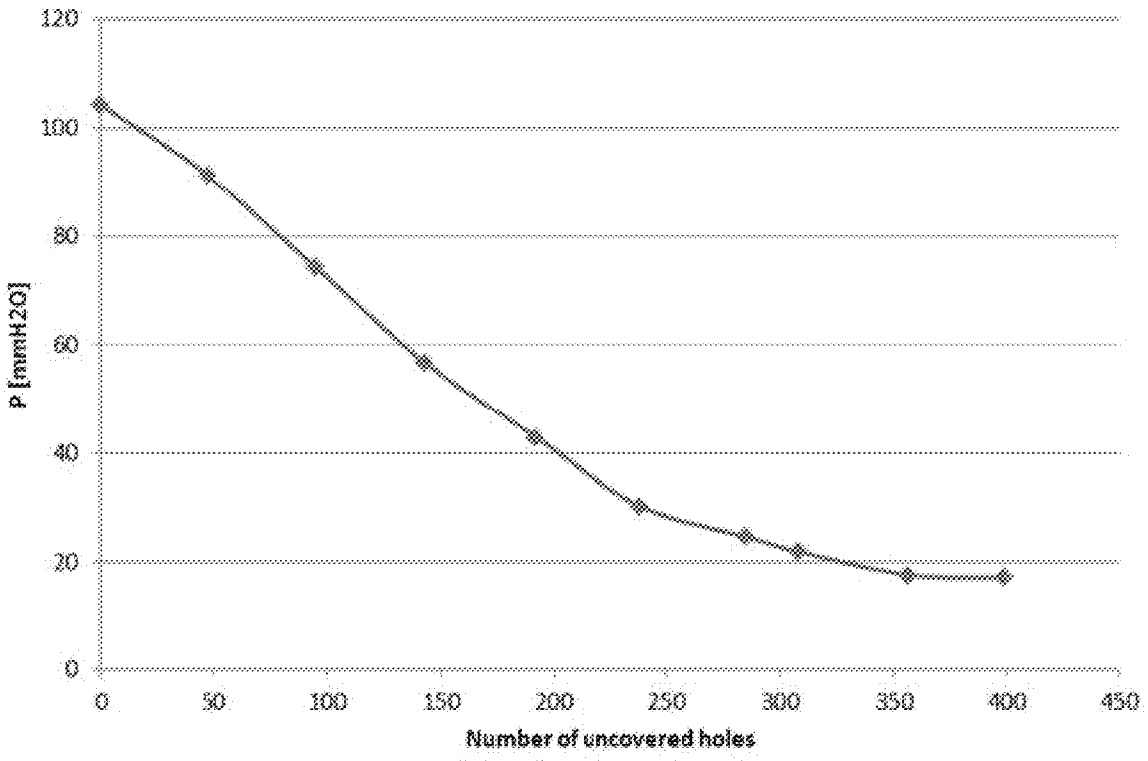
FIG. 4 shows a diagram for illustrating a change in vacuum pressure when more or less vacuum holes are covered by a print medium.

FIGS. 3A and 3B schematically show top views of a print media support assembly for illustrating how a print medium enters a print zone and leaves the print zone, respectively. The illustration of the print media support assembly is basically as in FIG. 1, including a print platen structure 10 and six vacuum belts (reference numbers of the belts have been omitted in order not to obscure the clarity of the drawings). The print platen structure 10 comprises a media input zone, a media output zone and a print zone wherein the media input zone is upstream of the print zone and the media output zone is downstream of the print zone. A print medium 40 is transported on the vacuum belts across the print platen structure 10, wherein, when the print medium enters the print zone, a leading edge is presented to the print platen structure, as shown in FIG. 3A and when the print medium leaves the print zone, a trailing edge is presented to the print platen structure 10, as shown in FIG. 3B. When the print medium is arriving at the print zone or leaving the print zone, there are many uncovered vacuum holes and the vacuum pressure drops, as schematically shown in the diagram of FIG. 4. As shown in FIG. 4, the vacuum pressure applied from the surface of the print platen structure drops significantly when the number of uncovered holes increases. In order to reduce this pressure drop, the number of through holes in the print platen structure can be reduced—differently in different areas of the print platen structure—as much as possible avoiding vacuum leakage but still ensuring a good media flatness or "ironing" effect. As explained with respect to FIG. 5 below, the requirement of vacuum performance is not the same for all areas of the print platen structure 10.

Figure 5:
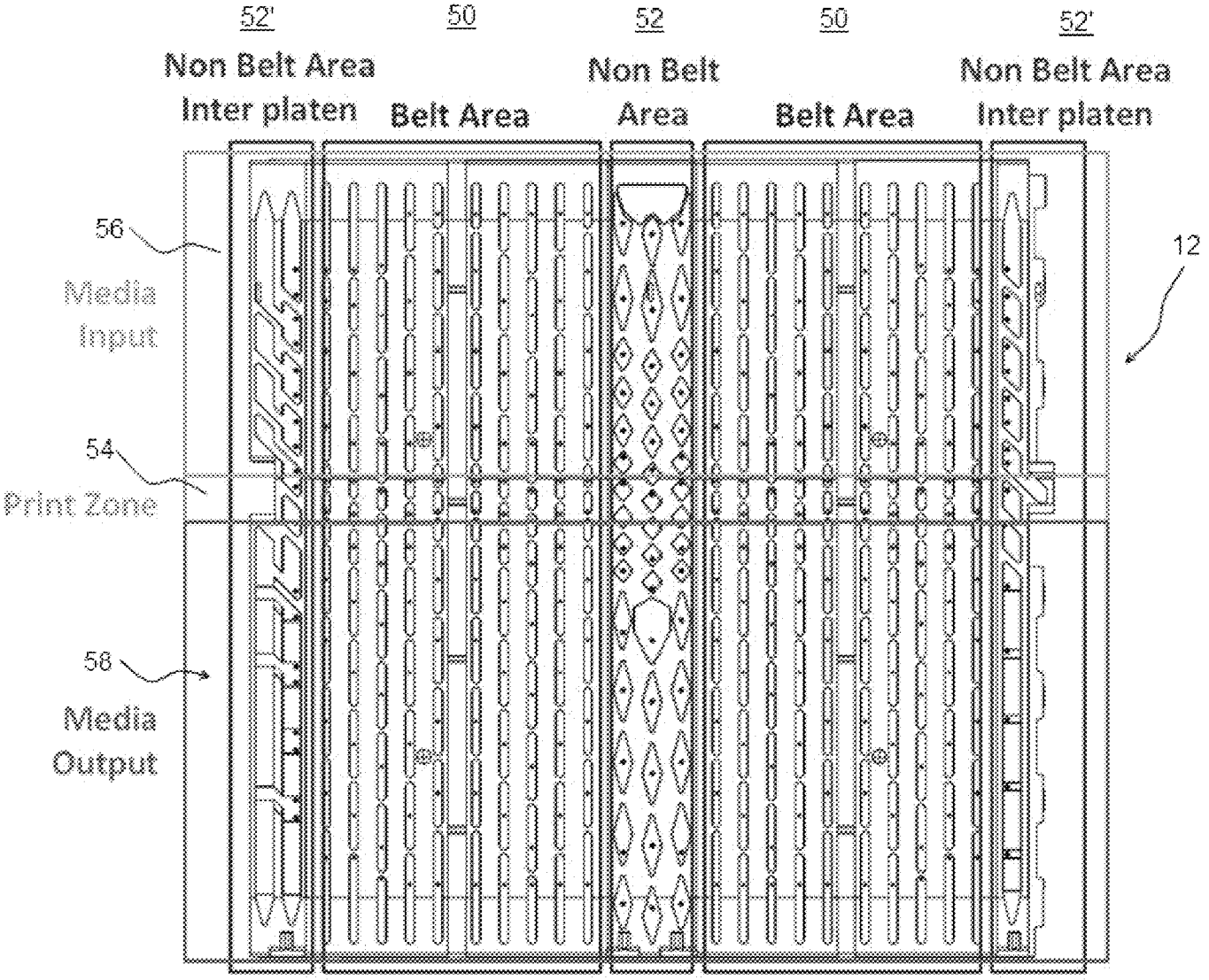
FIG. 5 shows a top view of a print platen module according to one example.

FIG. 5 shows a top view of one print platen module, corresponding to anyone of the modules 12 to 14, and 16. In the drawing, belt areas 50 and non-belt areas 52 are identified by respective boxes, these boxes extending in the longitudinal direction, or direction of print media transport. Belt areas 50 are those parts of the print platen module which are overlapped by a vacuum belt, as shown in FIG. 1, for example. Non-belt areas 52 are those parts of the print platen module, which are exposed between two neighboring belts or at the edges of the module. In FIG. 5, the non-belt areas 51 at the side edges of the print platen module 12 additionally are indicated to be "interplaten" areas, identified by 52'.

In the transverse direction, the print platen module 12 further may be divided into a print zone 54, a media input zone 56 and a media output zone 58. During operation of the printer, a print medium hence will be transported in the longitudinal direction, in the drawing from top to bottom, entering through the media input zone 56, then reaching the print zone 54 and leaving via the media output zone 58.

As shown in FIG. 5, the size and distribution of the through holes over the area of the print platen structure 12, and the size, geometry and distribution of the sinkholes are different between the media input zone 56, the print zone 54 and the media output zone 58 and also are different between the belt areas 50 and the non-belt areas 52 and further are different in the interplaten areas 52'. The through holes are illustrated by black dots and the sinkholes are illustrated by differently shaped circumferential lines defining different footprints, wherein reference numbers are omitted in order not to obscure the illustration of FIG. 5.

In the belt area 50, the combination of the print platen structure and the belts introduces a relatively high friction due to the normal force on the belt caused by the vacuum. In this region, it is desirable to minimize the hydraulic area of the sinkholes ensuring a good vacuum performance. In one example, the width of the sinkholes is made as small as the diameter of the through holes+/− the worst case of belt displacement in the transverse direction in order to ensure the feeding of the belt holes under all operating conditions. The width of the sinkholes in the belt areas can be e.g. about 4 mm, in each of the print zone, the media input zone and the media output zone.

To define the sinkhole length, in the longitudinal direction, it is differentiated between the print zone 54, the media input zone 56 and the media output zone 58. The sinkholes are working best when they are fully covered. In order to obtain a good vacuum in the print zone 54, the length of the sinkholes in this area corresponds to about half of the length of the print zone, e.g. about 10 mm. For the rest of the print platen module, having a high vacuum is less critical, because the requirement of media flatness is less critical. The length of the sinkholes in the media input zone 56 and the media output zone 58 hence is considerably larger than in the print zone and may be in order of about 35 mm for the media input zone and about 30 mm for the media output zone. In the example described, the sinkholes in the belt area have the shape of an elongated rectangle, having rounded corners, with a minimum width as explained above and of varying length depending on the area where the sinkholes are located. The sinkhole length is shortest in the print zone 54 and longest in the media input area 56. As also shown in FIG. 5, the through holes provided in the print platen module and the sinkholes are offset relative to each other in the transverse direction, perpendicular to media transport, in order to provide as much as possible a continuous vacuum to the bottom side of the belt.

In the non-belt area 52, which is not an interplaten area, the sinkhole shape of this example has been chosen to be a rhombus. A sinkhole having the footprint of a rhombus is advantageous in that the vacuum progressively increases and decreases and hence peaks of friction during media advance are avoided. The strategy of distributing the relative sizes of sinkholes in the non-belt area, between the print zone 54, the media input zone 56, and the media output zone 58, is similar to the belt area strategy. In one example, the width for all of the sinkholes is the same and may be about 8 mm, in one example it is 7.7 mm. The length of the sinkholes (in the longitudinal direction) in the print zone is the shortest, such as 10 mm and the length of the sinkholes in the media input zone and in the media output zone is considerably larger, for example 32 mm for the media input zone and 27 mm for the media output zone.

More generally speaking, in both the belt area and the non-belt area, the footprint of the sinkholes has a first size in the print zone, a second size in the media input zone, and a third size in the media output zone; wherein the first size is smaller than the second size and the third size, and the third size is smaller than the second size. In one example, the width of the sinkhole is the same among the sinkholes in the belt area and it is the same among the sinkholes in the non-belt area but the length of the sinkholes varies between the print zone, the media input zone and the media output zone. The above numbers and shapes are only examples and serve to illustrate the relative dimensions which will vary according to the size of the print platen structure including the different zones, the printing technology, the materials used, the nature of the print medium to be printed on and similar factors.

In the examples of a print platen structure which is relatively large, having a print media input zone and a print media output zone which are considerably larger than the print zone, the following relative dimensions may be encountered: the print zone length is about 5% to 10% of the total length of the print platen, e.g. 6%, 7%, 8%, or 9% of the total length of the print platen. The length of the media input zone is about 30% to 50% of the total length of the print platen, e.g. about 35%, 40%, or 45% of the total length of the print platen. The length of the media output zone is about 40% to 65% of the total length of the print platen, e.g. about 45%, 50%, or 55% of the total length of the print platen. The total length of the print platen is about 100 mm to about 500 mm, e.g. about 250 mm, 350 mm, or 450 mm.

The sinkhole strategy in the interplaten areas is again different and shall be explained in further detail and with reference to FIG. 8 below.

One example of the geometry and dimensioning of the sinkholes is indicated below:

| | Area | | | | | |
|---|---|---|---|---|---|---|
| | Belt Area | | | Non-Belt Area | | |
| | Shape | Width [mm] | Length [mm] | Shape | Width [mm] | Length [mm] |
| Media Input | Rectangle | 4 | 34 | Rhombus | 8 | 32 |
| Print Zone | Rectangle | 4 | 10 | Rhombus | 8 | 8 |
| Media Output | Rectangle | 4 | 30 | Rhombus | 8 | 27 |

Having regard to the diameter of the through holes in the print platen module 12, it again may be differentiated between belt areas 50 and non-belt areas 52 and further it may be differentiated between the print zone, media input zone and media output zone.

Within the belt areas 50, for defining the hole diameter, it is taken into account that the holes which are overlapped by the belts could be clogged by a mixture of ink and belt particles, such as dust, due to belt wearing. The maximum concentration of ink is located in the print zone 54 so that the diameter for the through holes which are located in the print zone 54 and the belt area 50 would be largest. The diameters for these holes could be in the range of 1.8 mm to 2.8 mm, e.g. about 2.1 mm, 2.3 mm, or 2.5 mm. On the other hand, the concentration of ink in the media input zone 56 is lower than in the print zone but higher than in the media output zone 58. Accordingly, the hole diameter for the through holes in the media input zone and the media output zone, corresponding to the belt area, may be lower than that in the print zone but still big enough to account for belt wear. Examples of through hole diameters are in the range of 1.5 mm to 2.3 mm, e.g. about 1.8 mm, or 2 mm for the media input zone and in the range of 1.5 mm to 1.8 mm, e.g. about 1.5 mm or 1.7 mm for the media output zone.

In the non-belt areas 52, there is no risk of belt particles clogging the through holes so that the hole diameter can be smaller. In one example, the hole diameter is selected to be in the range of 1.5 mm to 1.8 mm, e.g. about 1.5 mm or 1.7 mm for each of the print zone 54, the media input zone 56 and the media output zone 58. A summary of through hole diameters in the print platen structure according to one example is given by the table below:

| | Belt Area Diameter [mm] | Non-Belt Area Diameter [mm] |
|---|---|---|
| Media Input | 2 | 1.5 |
| Print Zone | 2.3 | 1.5 |
| Media Output | 1.5 | 1.5 |

The absolute values of through hole diameters, among others, will depend on the type of printing fluid used and on the material of the vacuum belts. It has been shown by experiments that a through hole diameter of less than 1.5 mm in the belt area results in a great part of the holes being clogged. A diameter of 1.5 mm hence is just acceptable for an area of low concentration of ink and belt dust. Starting at diameters of 2 mm and above, clogging becomes less of a problem. At a diameter of e.g. 2.3 mm clogging can be avoided to a large extent. In the non-belt areas, even at a through-hole diameter of only 1.5 mm, holes did not clog, despite of being in the most affected area, such as the print zone. This observation suggests that vacuum belt wear mostly affects clogging.

Figure 6:
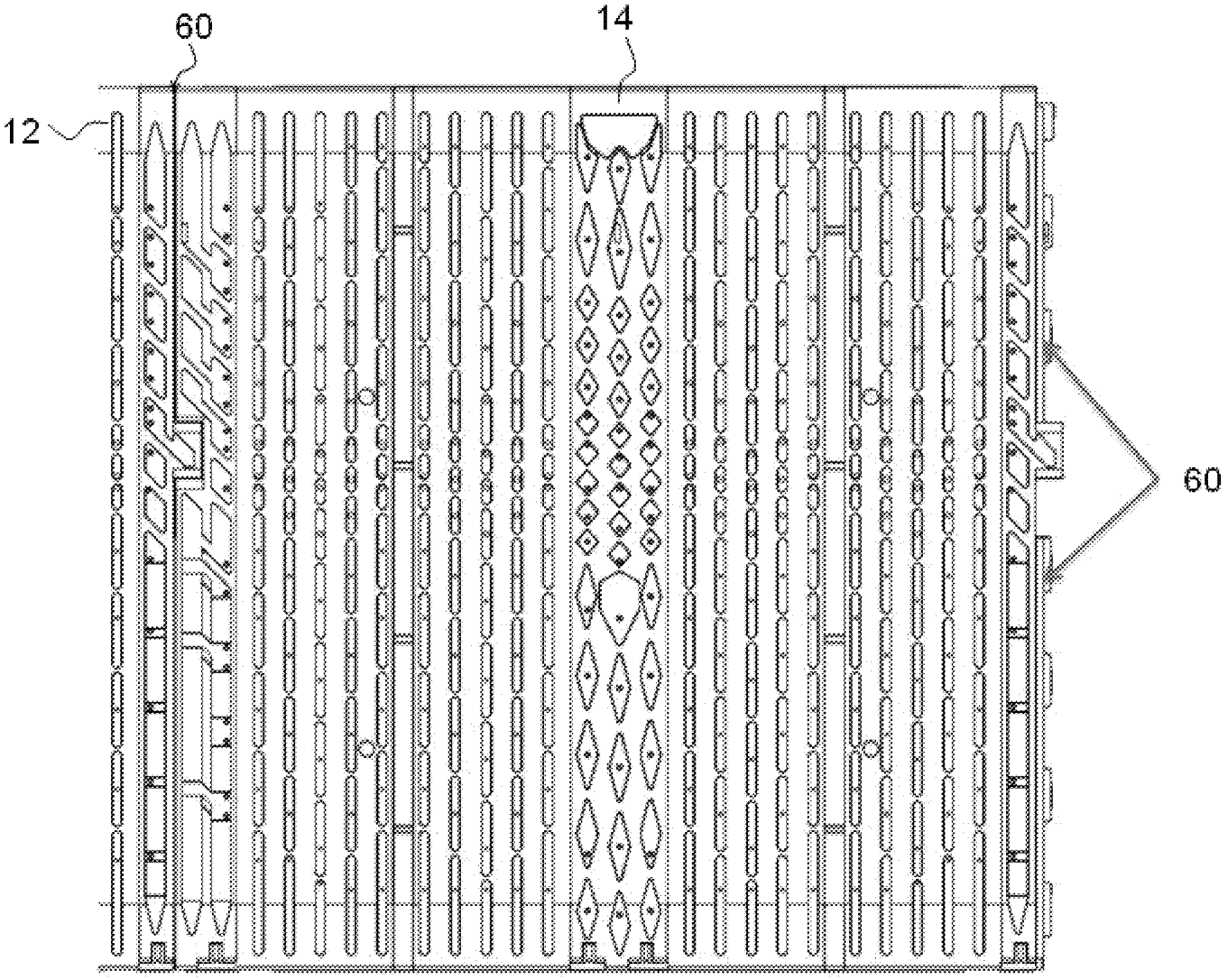
FIG. 6 shows a top view of part of a print platen structure according to one example.
Figure 7:
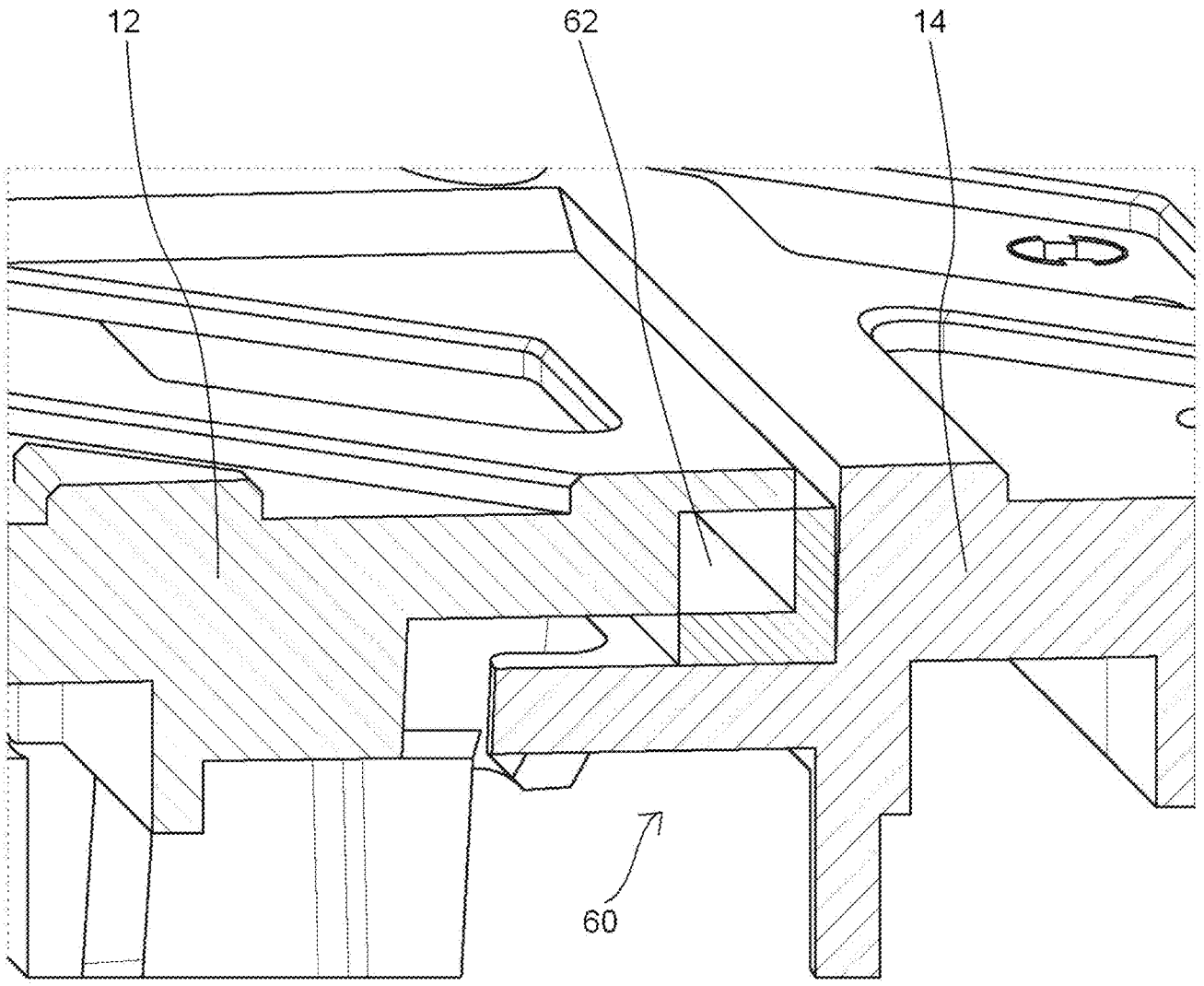
FIG. 7 shows a sectional view through part of a print platen structure according to one example.

In one or more examples of the present disclosure, the edge area or interplaten area 52' of each print platen module is configured differently from the rest of the module so as to provide an interface between the adjacent print platen modules having good vacuum performance and avoiding loss of a vacuum pressure. FIG. 6 shows part of a print platen structure including a print platen module 14 and part of a print platen module 12 which overlap at an interfacing edge 60. An opposite interfacing edge 60 of a print platen module 14 is shown unconnected to a next adjacent print platen module. This overlapping area is further illustrated in the sectional view of FIG. 7. In one example, to achieve an effective sealing between the adjacent print platen modules, such as modules 12 and 14, a compressed closed-cell foam member 62 is sandwiched between overlapping edge portions of the print platen module. There hence will be no vertical air gaps and no vertical air flow between adjacent print platen modules so that no vacuum can escape to the surface of the print platen. Using this structure for interfacing adjacent print platen modules facilitates obtaining large print platens, such as a platen of 1000 mm×350 mm having a high degree of flatness. The vacuum performance of the print platen modules at the interface edge 60 should be just as good as throughout the remainder of the print platen module to avoid wrinkles and cockles. Cockles of the print media, because paper expands when wet, usually would appear in the weakest point of vacuum. Hence, any gaps between the platen modules should be avoided. Any gaps are closed by the closed-cell foam member which may be pre-compressed or which may be compressed when inserted between overlapping interface edges 60 of adjacent print platen modules.

Figure 8:
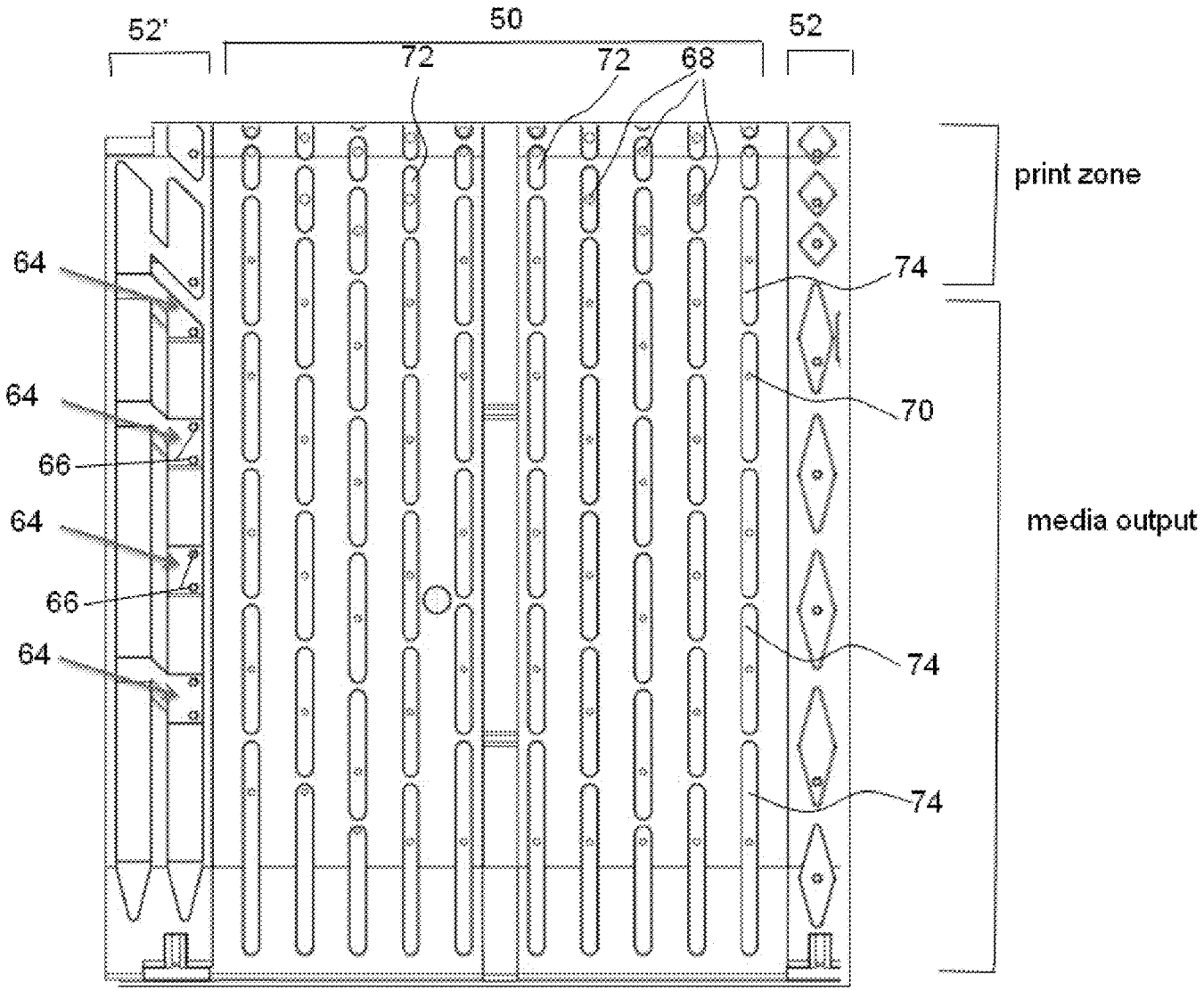
FIG. 8 shows a top view of part of a print platen structure according to one example.

FIG. 8 shows an enlarged view of the print platen module for illustrating how sinkholes may be varied in the interplaten edge regions 52' of the print platen modules. One reason for this modification of the sinkhole geometry and size is that it is difficult to provide a through hole extending through both of the overlapping interface edges 60 or even through the foam member 62. In one example, through holes in the interplaten edge regions 52' hence are provided with an offset to the outer edge of the module and the sinkhole geometry is modified so as to also provide a vacuum which extends to said outer edge. In the example shown in FIG. 8, sinkholes 64 are arranged at a distance from the outer edge of the module and each sinkhole is divided into a number of shorter holes, in the direction of media transport, with ramps between said section to divide the overall length of each of the sinkholes to improve vacuum performance. Further, each of the sinkholes is extended towards the side edge to also provide with vacuum the area close to the side edge. In order to supply sufficient vacuum to the sinkhole 64, at least some sinkholes can be associated with more than one through hole 66.

In the example shown, except for the interplaten edge area 52', one through hole is associated with each sinkhole, because it has been found that it usually is sufficient to provide one through hole per sinkhole. However, the present disclosure is not limited to such embodiments and more than one through hole can be associated with one or more sinkholes.

From FIG. 8, it also may be well recognized that the sinkholes 68, 70 may have different sizes and shapes depending on their location, e.g. whether they are in the print zone or in the media output zone illustrated in FIG. 8, or in the media input zone (not) shown. This figure also illustrates well how the through holes 68, 70 and the associated sinkholes 72, 74 (the reference numbers are associated only with some of the through holes and some of the sinkholes in order not to obscure the clarity of this description) are offset relative to each other in the media advance direction so as to apply as far as possible a continuous vacuum to the vacuum belts and the print media transported across the print platen structure.

In summary, examples of this disclosure provide a print media support assembly and a print platen structure having a good vacuum performance throughout the surface of the print platen. Friction between the print platen and a vacuum belt running across the print platen can be minimized even with high vacuum systems. Further, it is possible to provide very large platen structure for a large format printer without loss of vacuum at platen module interfaces. The print platen structures further is optimized in terms of improving vacuum performance in the area of leading and trailing edges of a print media running across the print platen to obtain an optimum media flatness even when the print medium is fed from a role imparting curling edges. Vacuum performance further can be optimized even when part of the print platen is without a print medium. Also, the effect of friction between the print platen surface and the vacuum belt running across is not only minimized, but it is also balanced between the two conditions that a print platen is covered by a print medium and the print platen is uncovered so as to achieve a stable and smooth a servo drive for driving the vacuum belts. The print platen assembly further is optimized in being insensitive against clogging from printing fluid and vacuum belt wear.

The invention claimed is:

1. A print media support assembly comprising:

a print platen structure having a number of through holes for applying a vacuum to a surface of the print platen structure, and a number of sinkholes in the surface of the print platen structure, each sinkhole associated with at least one through hole for distributing a vacuum, applied via the through holes, across the surface of the print platen structure, the print platen structure to support a print medium in a print zone; and a vacuum belt to run across the surface of the print platen structure in a direction of print media advance, the vacuum belt overlapping with only part of the surface of the print platen structure to form a belt area and a non-belt area on the print platen structure, wherein at least one of a density or a size of the through holes is different between the belt area and the non-belt area, and wherein an area or a shape of a footprint of the sinkholes is different between the belt area and the non-belt area.

2. The print media support assembly of claim 1, wherein the size of the through holes in the belt area is larger than in the non-belt area.

3. The print media support assembly of claim 1, wherein a footprint of the sinkholes in the belt area has a shape of a longitudinal rectangle or ellipse or of approximately a longitudinal rectangle or ellipse, in the direction of print media advance, and a footprint of the sinkholes in the non-belt area has a shape of a rhombus or of approximately a rhombus.

4. The print media support assembly of claim 1, wherein a footprint of the sinkholes in the belt area has a shape of a longitudinal rectangle or ellipse or of approximately a longitudinal rectangle or ellipse, and a width of the sinkholes, in a direction perpendicular to the direction of print media advance, is about 150% to 300% of a diameter of the associated through holes.

5. The print media support assembly of claim 1, comprising a plurality of vacuum belts to run across the surface of the print platen structure in the direction of print media advance, the plurality of vacuum belts being spaced from each other, wherein non-belt areas are formed between vacuum belts of the plurality of vacuum belts and at outer edge portions of the print platen structure not covered by the plurality of vacuum belts.

6. The print media support assembly of claim 1, wherein the print platen structure is to support the print medium also in at least one of a media input zone or a media output zone, wherein a density of through holes in the print zone is larger than a density of through holes in the at least one of the media input zone or the media output zone.

7. The print media support assembly of claim 1, wherein the print platen structure is to support the print medium also in at least one of a media input zone or a media output zone;

wherein a size of through holes in the print zone is larger than through holes in the at least one of the media input zone or the media output zone.

8. The print media support assembly of claim 1, wherein the print platen structure is to support the print medium also in at least one of a media input zone or a media output zone, wherein an area of a footprint of sinkholes in the print zone is smaller than in the at least one of the media input zone or the media output zone.

9. The print media support assembly of claim 1, wherein the print platen structure is to support the print medium also in a media input zone and in a media output zone, wherein, in the direction of print media advance, the print zone is short when compared to the media input zone and the media output zone, and wherein the print zone makes up not more than 20% of a surface area of the print platen structure.

10. The print media support assembly of claim 1, wherein the density of the through holes is different between the belt area and the non-belt area.

11. The print media support assembly of claim 1, wherein a distribution of the through holes is different between the belt area and the non-belt area.

12. A print media support assembly comprising:

a print platen structure having a number of through holes for applying a vacuum to a surface of the print platen structure, and a number of sinkholes in the surface of the print platen structure, each sinkhole associated with at least one through hole for distributing a vacuum, applied via the through holes, across the surface of the print platen structure, the print platen structure to support a print medium in a print zone, in a media input zone, and in a media output zone; and a vacuum belt to run across the surface of the print platen structure in a direction of print media advance, the vacuum belt overlapping with only part of the surface of the print platen structure to form a belt area and a non-belt area on the print platen structure, wherein at least one of a density or a size of the through holes is different between the belt area and the non-belt area, and wherein, in the belt area, the through holes have a first diameter in the print zone, a second diameter in the media input zone, and a third diameter in the media output zone, wherein the first diameter is larger than the second diameter, and the second diameter is larger than the third diameter.

13. The print media support assembly of claim 12, wherein a footprint of the sinkholes has a first size in the print zone, a second size in the media input zone, and a third size in the media output zone, wherein the first size is smaller than the second size and the third size, and the third size is smaller than the second size.

14. The print media support assembly of claim 12, wherein an area or a shape of a footprint of the sinkholes is different between the belt area and the non-belt area.

15. A print media support assembly comprising:

a print platen structure having a number of through holes for applying a vacuum to a surface of the print platen structure, and a number of sinkholes in the surface of the print platen structure, each sinkhole associated with at least one through hole for distributing a vacuum, applied via the through holes, across the surface of the print platen structure, the print platen structure to support a print medium in a print zone; and a vacuum belt to run across the surface of the print platen structure in a direction of print media advance, the vacuum belt overlapping with only part of the surface of the print platen structure to form a belt area and a non-belt area on the print platen structure, wherein at least one of a density or a size of the through holes is different between the belt area and the non-belt area, and wherein the print platen structure comprises a number of print platen modules arranged side by side, in a direction perpendicular to the direction of print media advance, and wherein adjacent print platen modules of the number of print platen modules overlap each other at side edges thereof.

16. The print media support assembly of claim 15, comprising a closed cell foam member sandwiched between the overlapping side edges of adjacent print platen modules.

17. The print media support assembly of claim 15, wherein a footprint of sinkholes lying in overlapping edge regions of the print platen modules are enlarged when compared to sinkholes in other parts of the print platen modules and are extended in a transverse direction.

18. A print media support assembly comprising:

a print platen structure having a number of through holes for applying a vacuum to a surface of the print platen structure, and a number of sinkholes in the surface of the print platen structure, each sinkhole associated with at least one through hole for distributing a vacuum, applied via the through holes, across the surface of the print platen structure, the print platen structure to support a print medium in a print zone; and a plurality of vacuum belts to run across the surface of the print platen structure in a direction of print media advance, the plurality of vacuum belts partially overlapping the surface of the print platen structure to form belt areas and a non-belt area on the print platen structure, the non-belt area being between adjacent vacuum belts of the plurality of vacuum belts, wherein at least one of an area or a shape of a footprint of the sinkholes is different between the belt areas and the non-belt area.

* * * * *